United States Patent [19]

Stevens et al.

[11] 4,327,790

[45] May 4, 1982

[54] FASTENER DRIVING DEVICE WITH MULTIPLE BITS

[75] Inventors: Larry G. H. Stevens, Georgetown; Edmund G. F. Sweet, Oakville; Franklin V. Vresk, Kitchener, all of Canada

[73] Assignee: MIC Manufacturing and Machine Works Ltd., Waterloo, Canada

[21] Appl. No.: 165,707

[22] Filed: Jul. 3, 1980

[51] Int. Cl.[3] ..... B25G 1/08

[52] U.S. Cl. ..... 145/62; 81/440; 81/450

[58] Field of Search ..... 145/62, 63, 61 L; 81/437, 439, 440, 450

[56] References Cited

U.S. PATENT DOCUMENTS

| | | | |
|---|---|---|---|
| 1,128,165 | 2/1915 | Mace | 81/450 |
| 1,616,300 | 2/1927 | Bido | 81/440 |
| 2,726,695 | 12/1955 | Malm | 145/61 L |
| 3,186,009 | 6/1965 | Simmons | 145/61 L |
| 3,315,295 | 4/1967 | Jeter et al. | 145/63 |

*Primary Examiner*—Stephen G. Kunin
*Assistant Examiner*—J. T. Zatarga
*Attorney, Agent, or Firm*—Fleit & Jacobson

[57] ABSTRACT

A screwdriver comprises a handle having four screwdriver blades pivotally connected adjacent one end. The blades may be pivoted from a stored position alongside the handle to an operative position in advance of the handle. A locking device locks the blade in an operative position and comprises a disc rotatably mounted on the one end of the handle with a slot to engage the blade. The slot has a radial portion and a circumferential position so that the blade first enters the radial portion and the disc is then rotated to hold the blade in the circumferential portion.

5 Claims, 5 Drawing Figures

FASTENER DRIVING DEVICE WITH MULTIPLE BITS

The present invention relates to tools and in particular to a screwdriver having a plurality of blades.

Screws are now available in a number of different head configurations to suit different uses. The most common configurations are a sloted head having a single diametric slot, a "Philips" head having a cross-shaped recess and a "Robertson" head having a square recess. Each of these configurations requires a different screwdriver to drive the screw and it is therefore necessary to keep a number of different screwdrivers available.

Prior proposals to reduce the required number of screwdrivers has resulted in a body with a number of different bits insertable into the body. These bits are separate from the body and are therefore easily lost, resulting in additional inconvenience.

There is therefore a need for a screwdriver which avoids the above disadvantages and which provides a choice of blades.

The present invention therefore provides a screwdriver in which a plurality of blades are pivotally connected to a handle. The blades are spaced about the axis of the handle and may be pivoted from a store position in which the blade lies alongside the handle to an operative position in which the blade extends forward from the handle. Lock means are provided between the handle and the blade to secure the blade in the operative position. Each of the blades is formed with a different end so that a plurality of different blades is provided.

The blades remain captive to the handle which prevents loss of the blades and the lock means ensures that the handle and blade are stable during use.

An embodiment of the invention will now be described by way of example only by reference to the accompanying drawings in which FIG. 1 is a perspective view of a screwdriver with a blade locked in an operative position.

Figure 1:
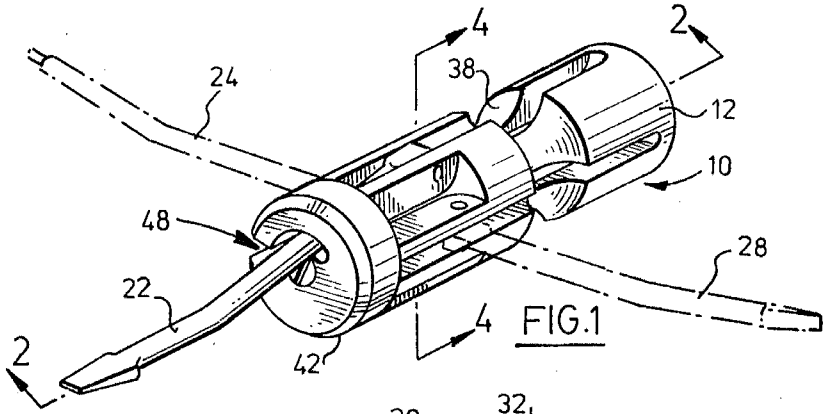
Figure 5:
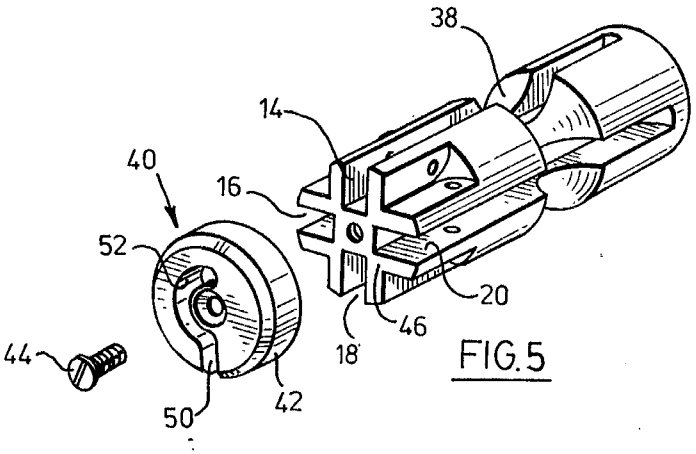
FIG. 5 is an exploded perspective view showing all the blades in a stored position.
Figure 4:
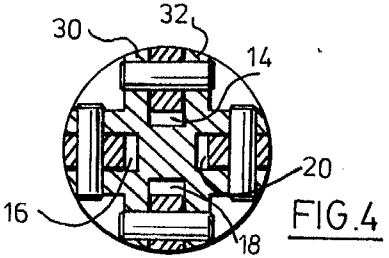
FIG. 4 is a section on the line 4—4 of FIG. 2.
Figure 3:
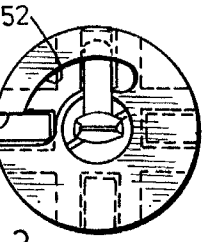
FIG. 3 is an end view in the direction of arrow A in FIG. 1.
Figure 2:
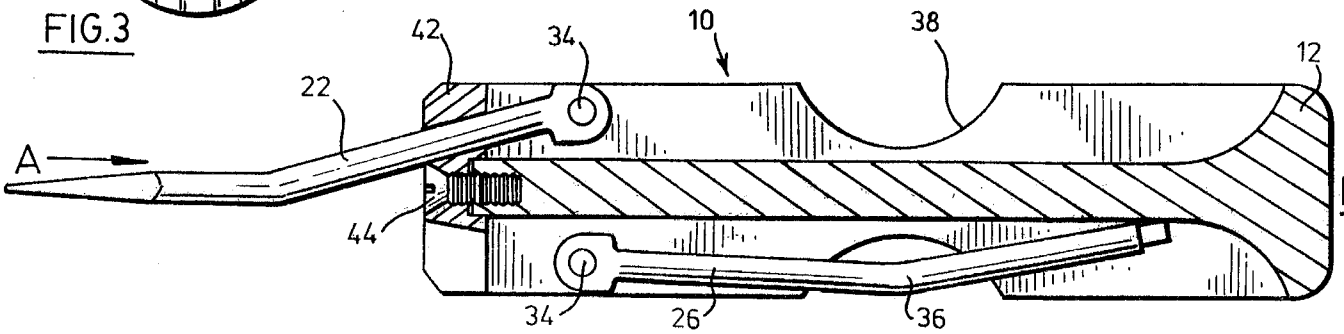
FIG. 2 is a section on the line 2—2 of FIG. 1.

Referring now to the drawings, a screwdriver 10 comprises a handle 12 having four recess 14, 16, 18, 20 extending parallel to the longitudinal axis of the handle. Each recess 14–20 accommodates a blade 22, 24, 26, 28 respectively. Each blade is formed with a different format so that two blades may be for Robertson screws of different sizes, one may be for a Philips screw and one may be for a slotted screw head. Obviously different combinations may be used as desired.

The handle 12 is scalloped at its lower or forward end to provide a pair of cheeks 30, 32 defining the lower portion of each of the recesses 14–20.

Each of the blades is pivotally secured to the handle 12 by a pin 34 extending between the cheeks 30, 32 of its respective recess. The blade may therefore pivot from a stored position in which the blade lies within the recess to an operative position in which the blade extends beyond the forward end of the handle.

The pins 34 are displaced radially from the longitudinal axis of the handle 12 and the blades 22–28 are cranked intermediate their ends, as at 36, so that in the operative position, the blade end lies on the longitudinal axis. A circumferentially extending notch 38 is formed in the handle 12 to intersect the recesses 14–20 adjacent the crank 36. This provides a convenient location to grip the blade for pivotal movement from the stored to the operative positions.

The blade is locked in its operative position by a locking device 40 which comprises a disc 42 rotatably mounted on a screw 44. The screw 44 is tapped to the handle 12 on the longitudinal axis and holds the disc 42 against an end face 46 of the handle 12. A notch 48 is cut into the disc 42 and includes a radial portion 50 and a circumferential portion 52. To lock the blade in a operative position, the radial portion 50 is aligned with the recess 14–20 of the required blade. The blade is then pivoted from the stored position to the operative position so that it enters the radial portion 50. The disc 42 is then rotated to move the circumferential portion around the blade and hold it in an operative position. After use, the blade may be stored by simply reversing the above procedure.

The blades not being used remain within the periphery of the handle 12. However, where extra leverage is required, two diametrically opposed blades may be lowered as indicated in dotted lines on FIG. 1 to act as a tommy bar.

The handle 12 may be machined from suitable material such as an aluminum alloy or may be molded from a suitable plastics material. Where a molded handle is utilized, extra strength may be built into the screwdriver by forming the pivots on a metal spider which is molded integrally with the handle 12.

It will be seen that a screwdriver having a plurality of captive blades is disclosed which provides the desired versatility to accommodate different screw formats without the disadvantages attendant with prior art devices.

Various modifications may be made to the device without departing from the scope of the invention. For example, the number of blades may be varied to suit the particular market requirements and if preferred a number of blades may be pivotally connected at each end of the handle. In this case the blades may be arranged in staggered fashion at opposite ends or may extend less then half the length of the handle.

Whilst the above description has used the term screwdriver it will be readily apparent that the device may be used to drive other forms of rotatable fastening, such as hexagonal headed bolts, by use of a suitable bit format.

The handle may also incorporate a ratchet device if desired to facilitate driving of the fasteners.

What we claim is:

1. A driving device for driving rotatable fasteners, said driving device comprising a handle, a plurality of driving bits spaced about said handle, pivot means pivotally connecting each of said bits to one end of said handle to permit movement of each of said bits from a stored position in which said bit lies alongside said handle to an operative position in which said bit extends beyond said one end of said handle and lock means rotatably supported on said handle and operable between said bit and said handle to lock said bit in said operative position, said lock means including a passageway selectively alignable with each of said bits by rotation of said lock means relative to said handle, said bit passing through said passageway in moving from said stored to said operative position and being locked in said operative position by rotation of said lock means to move said bit and said passageway out of alignment.

2. A driving device according to claim 1 wherein said bits are located within recesses in said handle in said stored position.

3. A driving device according to claim 1, wherein said lock means comprises a cap rotatably mounted on one end of said handle and having said passageway formed therein, said cap being rotatable upon entry of said bit in said passageway to move a circumferential wall into alignment with said bit to hold said bit in said operative position.

4. A driving device according to claim 3 wherein said passageway includes a radial portion and the circumferential wall is part of a connecting circumferential slot, said bit initially entering said radial portion and being held in said circumferential slot upon rotation of said cap.

5. A driving device according to claim 1 wherein said pivot means are spaced from the axis of said handle and said blades are cranked intermediate their ends to extend alongside said longitudinal axis in said operative position.

* * * * *